US010231594B2

(12) United States Patent
Mangano et al.

(10) Patent No.: US 10,231,594 B2
(45) Date of Patent: Mar. 19, 2019

(54) MOP WITH ROTATIONAL WRINGING MECHANISM

(71) Applicant: INGENIOUS DESIGNS LLC, Ronkonkoma, NY (US)

(72) Inventors: Joy Mangano, St. James, NY (US); Thomas James Philpott, Fort Mill, SC (US); Robert Patrick Warren, Charlotte, NC (US)

(73) Assignee: INGENIOUS DESIGNS LLC, Ronkonkoma, NY (US)

( * ) Notice: Subject to any disclaimer, the term of this patent is extended or adjusted under 35 U.S.C. 154(b) by 645 days.

(21) Appl. No.: 14/867,832

(22) Filed: Sep. 28, 2015

(65) Prior Publication Data

US 2016/0324387 A1 Nov. 10, 2016

Related U.S. Application Data

(60) Provisional application No. 62/159,099, filed on May 8, 2015, provisional application No. 62/159,475, filed on May 11, 2015.

(51) Int. Cl.

| | |
|---|---|
| ***A47L 13/142*** | (2006.01) |
| ***A47L 13/24*** | (2006.01) |
| ***A47L 13/14*** | (2006.01) |
| ***A47L 13/20*** | (2006.01) |
| ***A47L 13/252*** | (2006.01) |

(52) U.S. Cl.

CPC ..... *A47L 13/24* (2013.01); *A47L 13/14* (2013.01); *A47L 13/142* (2013.01); *A47L 13/20* (2013.01); *A47L 13/252* (2013.01)

(58) Field of Classification Search

CPC ..... A47L 13/10; A47L 13/14; A47L 13/142; A47L 13/20; A47L 13/24; A47L 13/58

See application file for complete search history.

(56) References Cited

U.S. PATENT DOCUMENTS

| | | | |
|---|---|---|---|
| 1,566,544 | A | 12/1925 | Kbebs |
| 2,835,914 | A | 5/1958 | Littleton |
| 2,944,431 | A | 7/1960 | Dexter |
| 3,197,169 | A | 7/1965 | Burrows |
| 4,145,787 | A | 3/1979 | Bastian |

(Continued)

FOREIGN PATENT DOCUMENTS

| | | |
|---|---|---|
| CN | 102525359 A | 7/2012 |
| CN | 203524595 | 4/2014 |

OTHER PUBLICATIONS

International Search Report dated Jul. 27, 2016 issued in corresponding PCT Application No. PCT/US/2016/029417.

(Continued)

*Primary Examiner* — Shay Karls

(74) *Attorney, Agent, or Firm* — Hunton Andrews Kurth LLP

(57) ABSTRACT

A mop includes a mop pole, a quick connect mechanism mounted to the bottom of the mop pole and capable of attaching to a mop head, a lower handle grip mounted around a lower portion of the mop pole and configured to move axially along the mop pole, the lower handle grip being capable of attached to a mop head, an upper handle grip at least partially mounted around an upper portion of the mop pole and configured to move axially along the mop pole, and a rotational mechanism capable of imparting rotation into the mop pole in response to axial movement of the upper handle grip.

19 Claims, 15 Drawing Sheets

(56) References Cited

U.S. PATENT DOCUMENTS

| | | | |
|---|---|---|---|
| 5,566,417 | A | 10/1996 | Hsieh |
| 5,722,105 | A | 3/1998 | Thomasson |
| 5,826,421 | A | 10/1998 | Wilcox |
| 5,842,810 | A | 12/1998 | Morad |
| 5,907,883 | A | 6/1999 | Thomasson |
| 5,918,340 | A | 7/1999 | Young |
| 6,321,409 | B1 | 11/2001 | Libman |
| 8,312,587 | B2 | 11/2012 | Chen |
| 8,316,502 | B2 | 11/2012 | Shao |
| 8,407,845 | B2 | 4/2013 | Yu |
| 8,739,347 | B2 | 6/2014 | Lin |
| 9,021,648 | B1 | 5/2015 | Chu |
| 2007/0151059 | A1 | 7/2007 | Petner |
| 2007/0186363 | A1 | 8/2007 | Chiang |
| 2009/0260169 | A1 | 10/2009 | Chen |
| 2010/0287722 | A1 | 11/2010 | Yu |
| 2011/0277259 | A1 | 11/2011 | Chen |
| 2012/0233794 | A1 | 9/2012 | Yu |

OTHER PUBLICATIONS

International Search Report dated Jul. 27, 2016 issued in corresponding PCT Application No. PCT/US/2016/029432.

MOP WITH ROTATIONAL WRINGING MECHANISM

CROSS-REFERENCE TO RELATED APPLICATIONS

This application claims benefit under 35 U.S.C. § 119(e) of U.S. Provisional Application Ser. No. 62/159,099, filed May 8, 2015, and U.S. Provisional Application Ser. No. 62/159,475, filed May 11, 2015, both of which are incorporated, in their entirety, by this reference.

TECHNICAL FIELD

The present disclosure relates to a durable cleaning mop, the mop capable of wringing water and cleaning solution out of a saturated string-type, braided cord mop head.

BACKGROUND

Mops are an essential cleaning tool for many households and businesses. Over time, improvement of mops and related technologies has resulted in several categories of mops, each with specialized capabilities and intended uses. Generally, mop categories include flat-mops (including sponge, scrubbing pad, and disposable pad or "Swiffer" type mops), string-mops, and centripetal spin-mops. Cleaning with a mop can be achieved with either a wetted mop, or a dry mop. Within each category, specialized designs exist that are best suited to either wet or dry use. For fast daily maintenance cleaning, dry flat mops are often preferred. For periodic thorough cleaning, or for larger and/or wet and dirty jobs, a wet mop is required.

In order to use a wet mop, a source of liquid is required. Until recently, this meant that a bucket of water and/or a cleaning solution, or another vessel of water, such as a sink, would need to accompany a mop. Several varieties of mops now exist with a built-in liquid supply, and application means, typically a hand operated pump and sprayer. Less commonly, products exist with a separate backpack mounted fluid tank, and a means to deliver the liquid to the mop head fibers or flat pad. These are typically for commercial or institutional use.

String-mops have proven to be the preferred choice for wet mop applications, especially when large areas of flooring must be cleaned. There are two main types of mop heads utilized within the string mop category: looped and open ended mop designs. A looped mop head utilizes a continuous string, often several hundred feet in length. This string loops back and forth repetitively. Open ended mop heads use cut lengths of string, bundled and attached together. This results in cut ends of the strings contacting the floor, and typically faster absorption of the cleaning liquid solution.

Over time, string-mops have evolved from utilizing a conventional straight string into utilizing a more durable twisted string. Twisted strings are generally formed by coiling several strands together in the same direction, where the fibers within each of the strands must twist in the opposite direction as the corresponding strands. Stitch threads are generally used to keep the fibers twisted at a particular geometry. The result is a twisted string which hangs straight and resists kinking String-mops inherently absorb large volumes of water, whether from the cleaning solution vessel or from the flooring surface that is being cleaned. This strength is balanced by a weakness: a high level of resistance to releasing the liquid, once absorbed. As a result, several wringing mechanisms have been conceived, and are commercially available today.

While string-mops continue to be popular, they have two critical flaws. First, wringing effectiveness is dictated by the user's strength, and willingness or capability to rotate the mop's handle grip, relative to the main handle, through several full revolutions. This is both time consuming, and fatiguing. Second, each end of a twisted string must be fused together to prevent unraveling. Thus a simple tear can cause the string to become untwisted, unraveled, and unusable.

Hence, a need exists for an improved mop with a wringing mechanism that provides for substantially quicker and physically easier use and a mop head with improved durability that provides the same or increased absorbent qualities as conventional mops.

SUMMARY

The present disclosure relates to a durable cleaning mop capable of wringing water and cleaning solution out of a saturated string type mop head.

In accordance with certain aspects of the present disclosure, a mop includes a mop pole, a lower handle grip mounted around a lower portion of the mop pole and configured to move axially along the mop pole, an upper handle grip at least partially mounted around an upper portion of the mop pole and configured to move axially along the mop pole, and a rotational mechanism capable of imparting rotation into the mop pole in response to axial movement of the upper handle grip.

In accordance with certain aspects of the present disclosure, a mop head includes a collar and a braided cord comprised of a plurality of strands. The collar is positioned at a top end of the mop head and is capable of attaching around a lower portion of a lower handle grip of a mop pole. The braided cord is arranged around the collar and attached to itself such that the cord forms a plurality of apertures and a plurality of loops.

In accordance with certain aspects of the present disclosure, a collar for a mop head includes a body capable of securing a mop head to a mop pole. The collar body may include a post end and a loop end, where the loop end is configured to accept the post end. The collar is capable of attaching around a lower portion of a lower handle grip of a mop pole.

The invention may be embodied by numerous other devices and methods. The description provided herein, when taken in conjunction with the annexed drawings, discloses examples of the invention. Other embodiments, which incorporate some or all elements as taught herein, are also possible.

BRIEF DESCRIPTION OF THE DRAWINGS

The various objects, advantages and novel features of this invention will be more fully apparent from a reading of the following detailed description in conjunction with the accompanying drawings in which like reference numerals refer to like parts, and in which.

DETAILED DESCRIPTION

The present inventive concepts now will be described more fully hereinafter in the following detailed description of the invention, in which some, but not all embodiments of the invention are described. Indeed, these inventive concepts may be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the inventive concepts. As used herein, the term "and/or" includes any and all combinations of one or more of the associated listed items. As used herein, the singular forms "a," "an," and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the inventive concepts, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure relates to a durable cleaning mop capable of wringing water and cleaning solution out of a saturated string type mop head. It provides an improved mop and mop head, of similar construction to the previously described string-mops.

Figure 1:
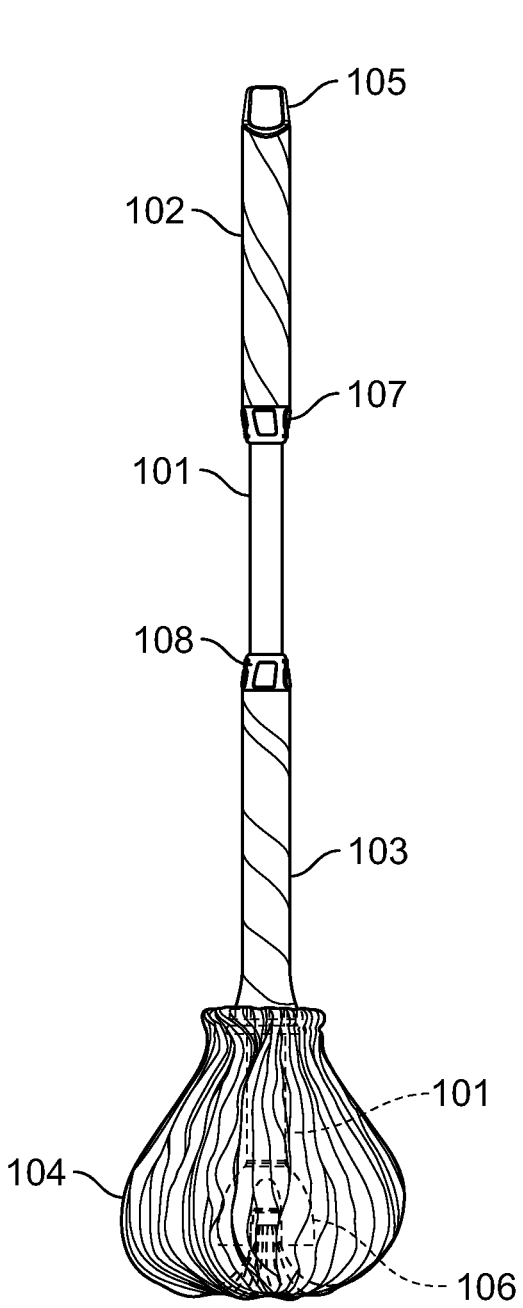
FIG. 1 illustrates a cleaning mop in accordance with certain embodiments of the present disclosure.

FIG. 1 illustrates a cleaning mop in accordance with certain embodiments of the present disclosure. The cleaning mop 100 includes, among other things, an upper handle grip 102, a lower handle grip 103, and a mop head 104 attached to a mop pole 101.

The upper handle grip 102 is mounted around and configured to slide axially about an upper portion of the mop pole 101 and, in some examples, can be attached to an upper locking structure 107. Additionally, the upper handle grip 102 encloses an internal rotational mechanism (not shown) that can impart rotation into the mop pole 101 when the upper handle grip 102 moves axially along the mop pole 101.

The lower handle grip 103 is mounted around and configured to slide axially about a lower portion of the mop pole 101 and, in some examples, can be attached to a lower locking structure 108. Additionally, the lower handle grip 103 is removably attached to a top end of the mop head 104.

The mop head 104 can be any looped mop head, which can attach to the lower handle grip 103 and the mop pole 101. As shown in FIG. 1, the top of the mop head 104 can be attached to the lower handle grip 103 while the bottom of the mop head 104 can be attached within a cup 106 connected to the bottom end of the mop pole 101. As a result, axial movement of the lower handle grip 103 along the mop pole 101 can stretch or relax the loops of the mop head 104.

It is also contemplated that the cleaning mop 100 can include a hook 105 secured to the top of the mop pole 101. The shape and size of the hook can vary in alternate examples to permit, inter alia, the cleaning mop 100 to hang on a wall hook.

Figure 2:
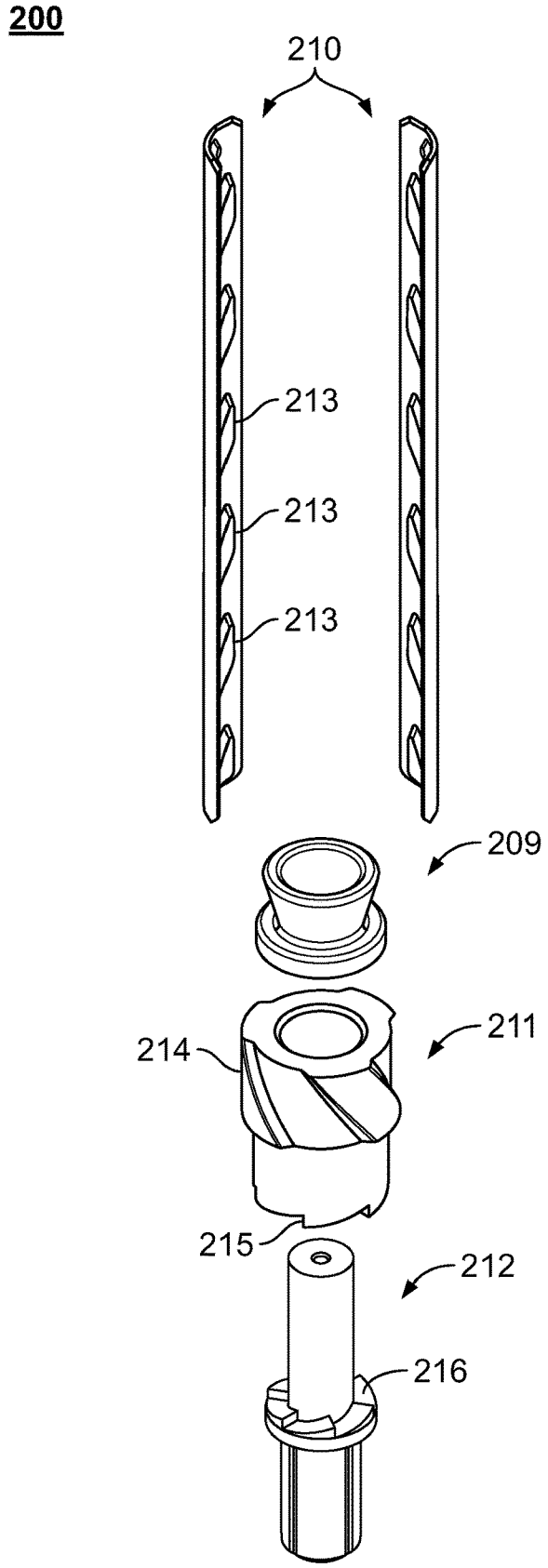
FIG. 2 is an exploded view of a rotational mechanism of the cleaning mop of FIG. 1 in accordance with certain embodiments of the present disclosure.

FIG. 2 is an exploded view of a rotational mechanism 200 of the cleaning mop 100 in accordance with certain embodiments of the present disclosure. The rotational mechanism 200 is enclosed within the upper handle grip 102 such that axial movement of the upper handle grip 102 causes the rotational mechanism 200 to impart rotation into the mop pole. The rotational mechanism 200 includes inserts 210, a plug 209, a rotating element 211, and a rotatable portion 212.

The inserts 210 are securely attached to the inter walls of the upper hand grip 102. The rotational mechanism 200 is not limited to two inserts 210 as illustrated in FIG. 2. In some examples, the rotational mechanism 200 includes more than two inserts 210. The inserts 210 have a plurality helical prongs 213 molded therein. It is to be appreciated that the plurality of helical prongs 213 may be manufactured directly as part of the inter walls of the upper hand grip 102, during molding of the upper hand grip 102, in which case separate inserts 210 are not needed.

One end of the rotatable portion 212 is inserted in an upper end of the mop pole 101, and the other end of the rotatable portion 212 is inserted in a hollow core of the rotating element 211. With such a configuration, as the upper handle grip 102 is moved axially along the mop pole 101, the helical prongs 213 of the inserts 210 catch helical grooves 214 of the rotating element 211 and cause the rotating element 211 to rotate. In a gear-like fashion, teeth 215 of the rotating element 211 catch teeth 216 of the rotatable portion 212, thereby imparting rotation on the mop pole 101. The plug 209 is attached to an end of the rotating element 211 to serve as a damper, which may, among other things, absorb any force that may damage the rotational mechanism 200 or absorb any shock that may be felt by a user of the mop 100.

In some examples, the rotational mechanism 200 imparts rotation into the mop pole 101 only when the upper handle grip 102 moves axially in a downward direction and does not affect the mop pole 101 when the upper handle grip 102 moves axially in an upward direction. Likewise, in some examples, the rotational mechanism 200 imparts rotation into the mop pole 101 only when the upper handle grip 102 moves axially in an upward direction and does not affect the mop pole 101 when the upper handle grip 102 moves axially in a downward direction. Therefore, the mop allows for multiple strokes of the of the upper handle grip 102, each successively wringing the mop head fibers tighter.

While FIG. 1 illustrates an entirely hidden rotational mechanism, some parts of the rotational mechanism may be visible. For instance, a hidden rotational mechanism may be more comfortable for the user and may be substantially safer. In contrast, a partially visible rotational mechanism may allow for easy maintenance.

Figure 3:
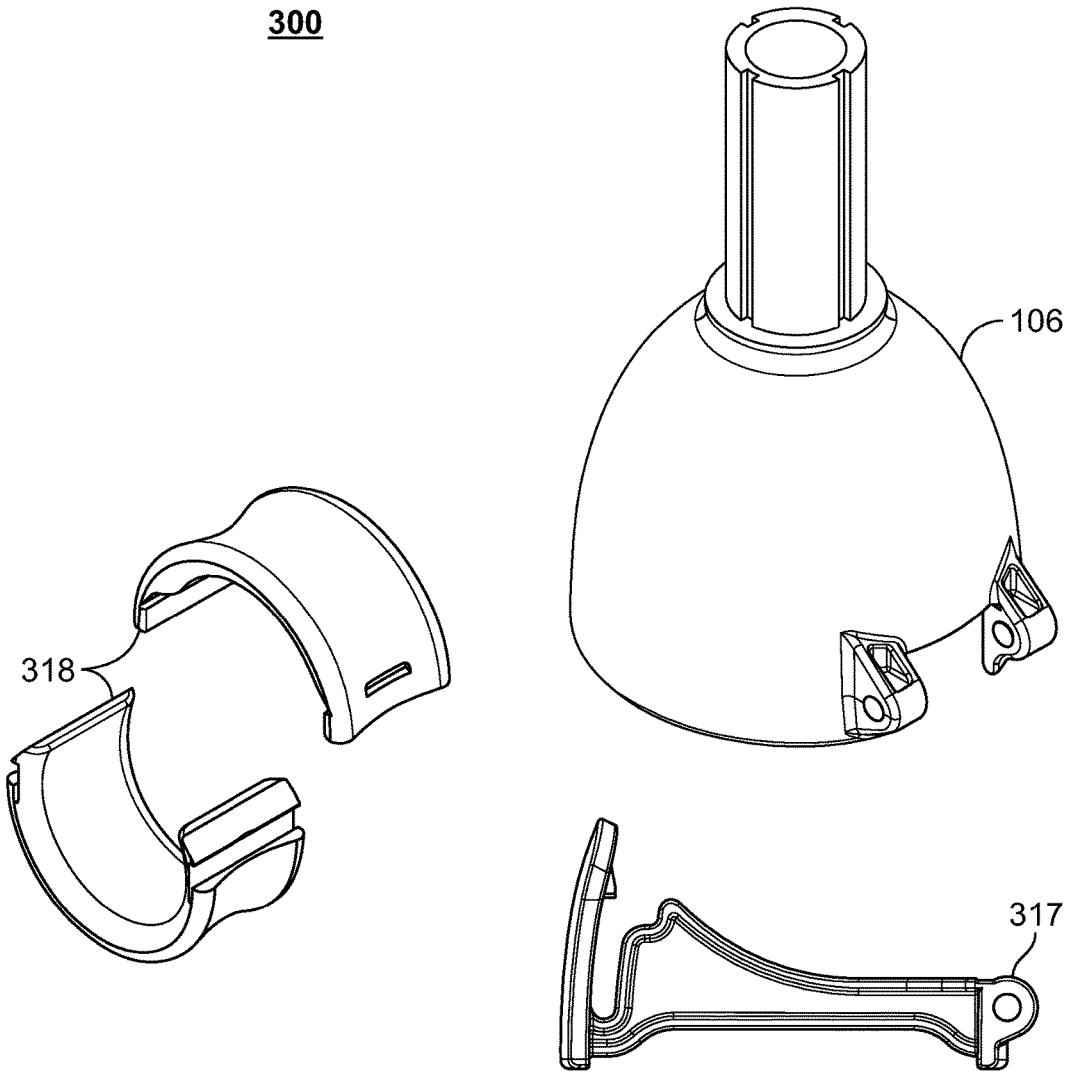
FIG. 3 is an exploded view of a quick connect mechanism for the cleaning mop of FIG. 1 in accordance with certain embodiments of the present disclosure.

FIG. 3 is an exploded view of a quick connect mechanism 300 for the cleaning mop 100 in accordance with certain embodiments of the present disclosure. In this example, the quick connect mechanism 300 includes the cup 106, a hinged member 317, and a lock ring 318. The lock ring 318 includes at least two semi-circular pieces that are snap fitted around the bottom portion of the mop head 104, and the cup 106 is connected to the bottom end of the mop pole 101. Subsequently, to connect the bottom portion of the mop head 104 to the cup 106, the lock ring 318 is inserted into the cup 106 and the hinged member 317 is closed onto the cup 106 such that the lock ring 318 is secured within the cup 106.

Figure 4:
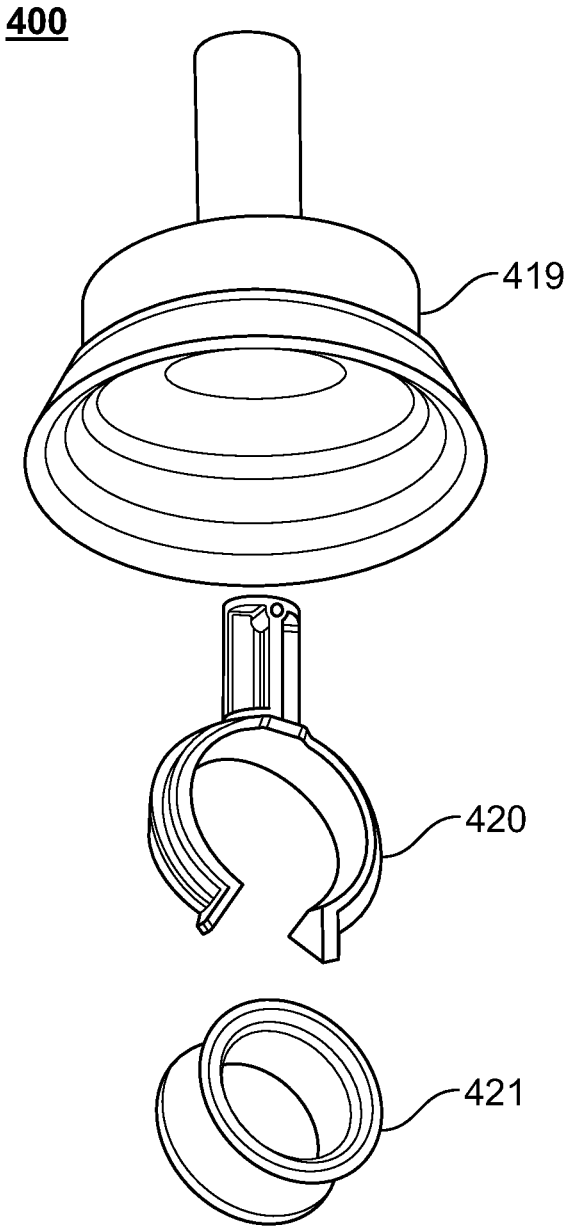
FIG. 4 is an exploded view of a quick connect mechanism for the cleaning mop of FIG. 1 in accordance with certain embodiments of the present disclosure.

FIG. 4 is an exploded view of another quick connect mechanism 400 for the cleaning mop 100 in accordance with certain embodiments of the present disclosure. Here, the quick connect mechanism 400 includes a cup 419, a receiver clip 420, and a lock ring 421. Unlike the lock ring 318, the lock ring 421 is made of a single piece of material, such as molded nylon, and is permanently mounted on the bottom portion of the mop head 104. The receiver clip 420 is attached to the cup 419. In this example, the receiver clip 420 is configured to accept the lock ring 421 which is attached to the bottom of the mop head 104.

Figure 5:
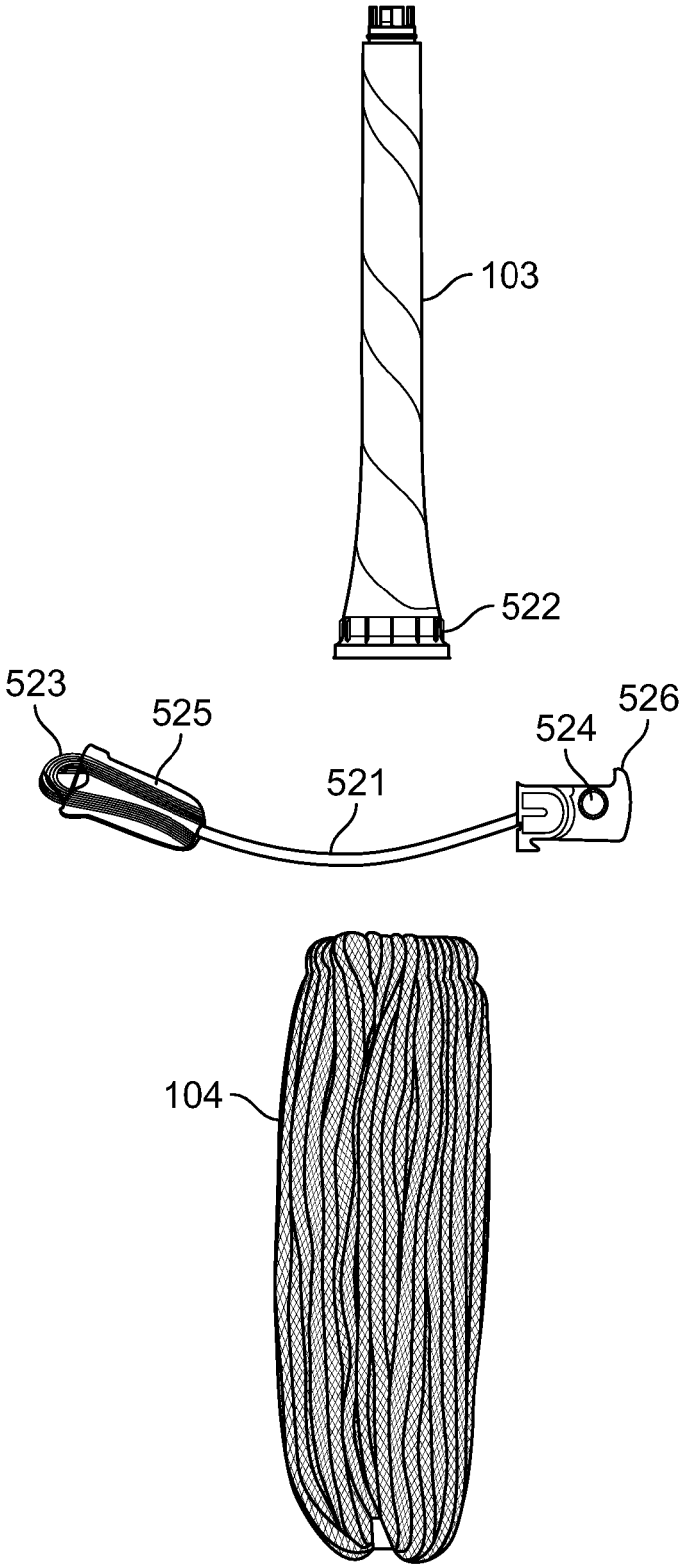
FIG. 5 is an exploded view of the mop head connection with the lower handle grip of FIG. 1 in accordance with certain embodiments of the present disclosure.

FIG. 5 is an exploded view of the mop head 104 connection with a lower portion 522 of the lower handle grip 103 in accordance with certain embodiments of the present disclosure. In this example, the top of the mop head 104 is attached to a lower portion 522 of the lower handle grip 103 by a collar 521, around which a top of the mop head 104 is wrapped.

In an embodiment of the present invention, the collar 521 may be a wire having its two ends connected to each other (for example, by looping the ends around each other, by welding, etc.) to form a loop. In such embodiment, the lower handle grip 103 may be fed through the loop formed by the collar 521 and the mop head 104. In other embodiments, as illustrated in FIG. 5, the collar 521 may include a post end 524 and a loop end 523 and may be configured to wrap around a lower portion 522 of the lower handle grip 103, where the loop end 523 is configured to accept the post end 524, thus securing the top of the mop head 104 to the lower handle grip 103. The post 524 and loop 523 connection of the collar 521 may permit the mop head 104 to disconnect from the lower handle grip 103 whenever the user desires.

In some examples, as seen in FIG. 5, the post end 524 of the collar 521 has a hook feature 526 to prevent the mop head 104 from undesirably falling off the post end 524 of an unconnected collar 521. Likewise, in some examples, the loop end 523 can have a flared shape (not shown) to prevent the mop head from undesirably falling off the loop end 523 of an unconnected collar 521.

As shown, the post end 524 and the hook feature 526 are parts which can be "over-molded" or "insert molded" over the collar 521. Likewise, the loop end 523 of the collar 521 can be bent and "over-molded." Thus, a portion of the wire is left unmolded to retain an aperture which can accept the post end 524 of the collar 521.

In some examples, the loop end 523 is a C-Clip (not shown) which is equipped with a post and loop type clasp. The C-Clip can allow slight overlap of the mop head fibers, preventing the formation of a gap down the length of the mop head 104.

The collar 521 may be made of a variety of materials including galvanized steel wire and silicone coated annealed wire.

Figure 6:
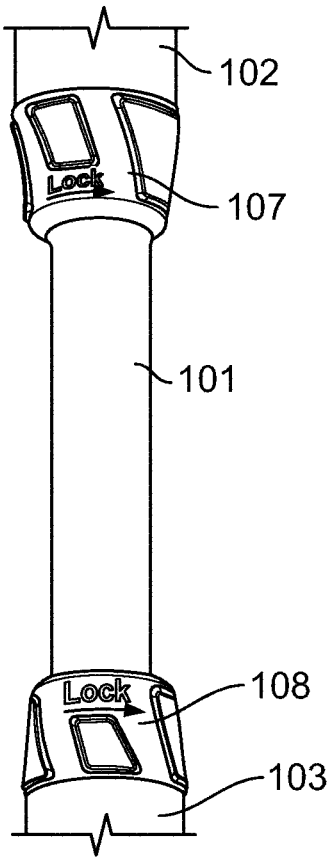
FIG. 6 is a close-up view of locking structures of the cleaning mop of FIG. 1 in accordance with certain embodiments of the present disclosure.

FIG. 6 is a close-up view of the locking structures 107 and 108 of the cleaning mop 100 in accordance with certain embodiments of the present disclosure. In this example, the upper handle grip 102 and the lower handle grip 103 each include the locking structures 107 and 108, respectively. As shown, the locking structures 107 and 108 can include a locking ring to clamp and fix their positions relative to the mop pole 101. Thus, a user can adjust the position of the lower handle grip 103 or the upper handle grip 102 and can secure it in the adjusted position with the respective locking structure by turning the locking ring 107 or 108 in the appropriate direction.

Referring back to FIG. 1, the lower handle grip 103 is free to rotate and slide axially about the mop pole 101, so as to create three modes of operation: mopping mode, drying mode, and wringing mode. In this example, the bottom of the mop head 104 is attached to the mop pole 101 via a quick-connect mechanism (not shown) and the top of the mop head 104 is attached to the lower handle grip 103 via a collar (not shown). The lower handle grip 103 is configured to slide axially about the mop pole 101, thereby stretching or relaxing the loops of the mop head 104.

Figure 7:
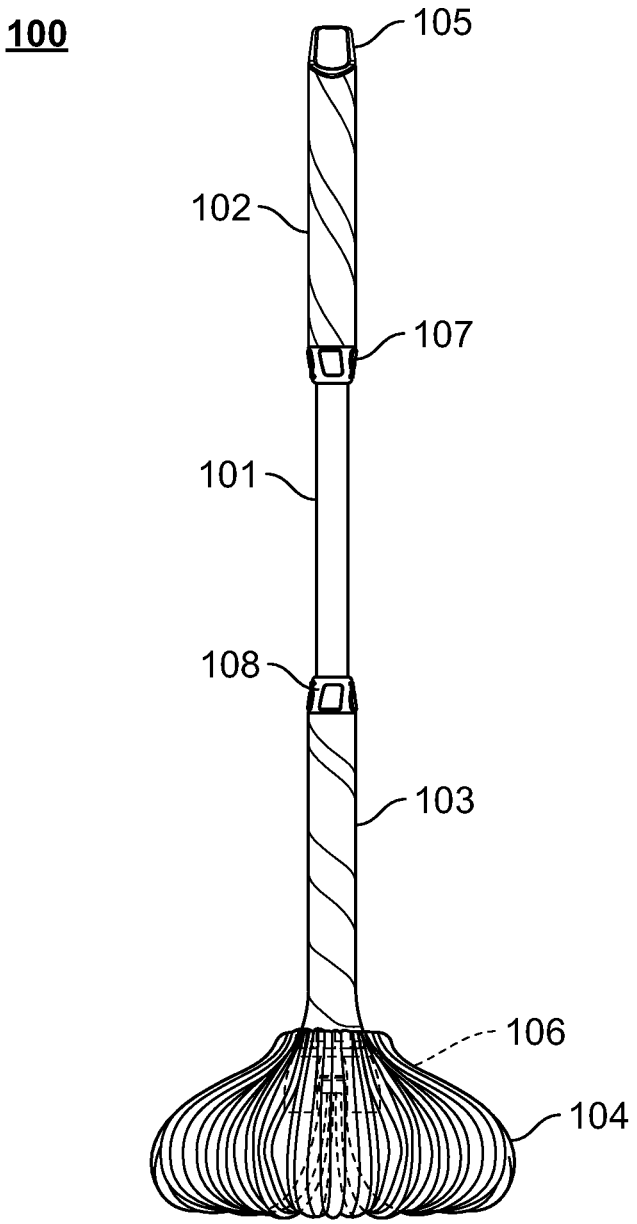
FIG. 7 illustrates the cleaning mop in FIG. 1 in a mopping mode in accordance with certain embodiments of the present disclosure.

FIG. 7 illustrates the cleaning mop 100 in the mopping mode in accordance with certain embodiments of the present disclosure. As shown in FIG. 7, as the lower handle grip 103 slides closer to the bottom of the mop pole 101, the top and bottom ends of the mop head 104 get closer together and the loops of the mop head 104 droop. The cleaning mop 100 is in the mopping mode when the lower handle grip 103 is moved to the lower handle grip's bottom-most position on the mop pole 101, wherein the loops of the mop head 104 are fully drooped, and thereby allowing optimal flat surface cleaning The cleaning mop 100 can be locked into mopping mode using the lower locking structure 108.

Figure 8:
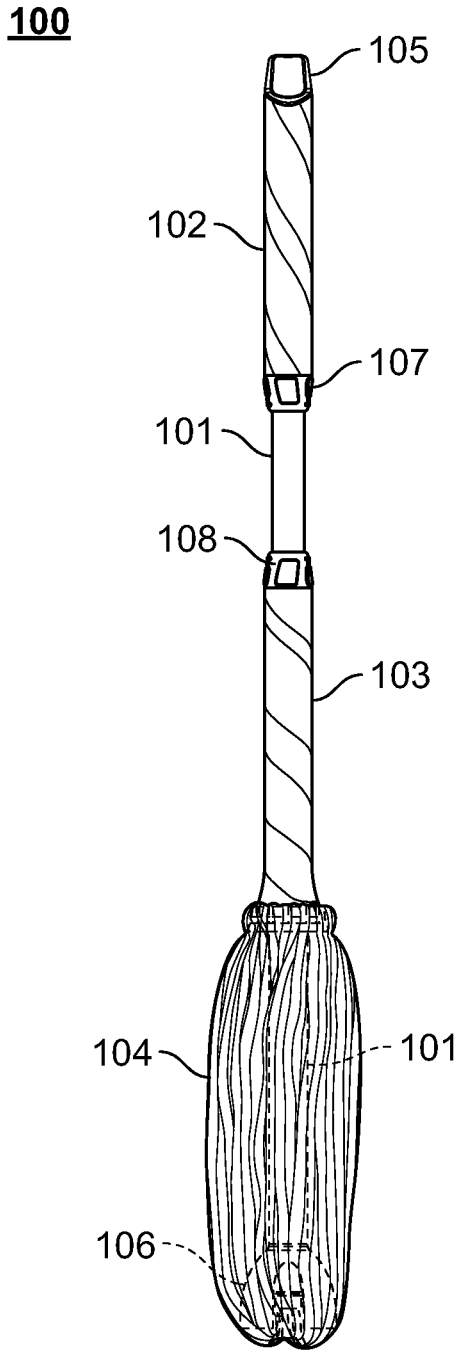
FIG. 8 illustrates the cleaning mop in FIG. 1 in a drying mode in accordance with certain embodiments of the present disclosure.

FIG. 8 illustrates the cleaning mop 100 in the drying mode in accordance with certain embodiments of the present disclosure. As the lower handle grip 103 slides higher along the mop pole 101, the top and bottom ends of the mop head 104 get further apart and the loops of the mop head 104 become stretched. The cleaning mop 100 is in the drying mode when the lower handle grip 103 is moved to the lower handle grip's top-most position on the mop pole 101, wherein the loops of the mop head 104 are fully stretched. Additionally, the mop can be locked into drying mode using the lower locking structure 108.

Similarly, the cleaning mop 100 can be in the wringing mode by stretching the loops of the mop head 104 using the lower handle grip 103 and then rotating the bottom of the mop head using the upper handle grip 102.

The method of wringing the mop is generally a two-handed operation. However, no rotation of the user's hands, relative to each other, is required to achieve effective wringing of the mop. In some examples, the method of wringing the mop involves the user, with a first hand, lifting the lower handle grip 103, stretching the loops of the mop head 104, and supporting the mass of the mop. While the lower handle grip 103 is still being held with the first hand, the upper handle grip 102 is moved upward along the mop pole 101 and then downward along the mop pole 101 with a second hand. Upon downward motion of the upper handle grip 102, the mop pole 101 rotates, and in turn rotates the bottom of the mop head 104 relative to the top of the mop head 104. This twisting of the mop head 104 results in compression of the loops, and release of the liquid absorbed in the mop head 104.

Likewise, in some examples, the method of wringing the mop involves the user, with a first hand, lifting the lower handle grip 103, stretching the loops of the mop head 104, and supporting the mass of the mop. While the lower handle grip 103 is still being held with the first hand, the upper handle grip 102 is moved downward along the mop pole 101 and then upward along the mop pole 101 with a second hand. Upon upward motion of the upper handle grip 102, the mop pole 101 rotates, and in turn rotates the bottom of the mop head 104 relative to the top of the mop head 104. This twisting of the mop head 104 results in compression of the loops, and release of the liquid absorbed in the mop head 104.

Figure 9:
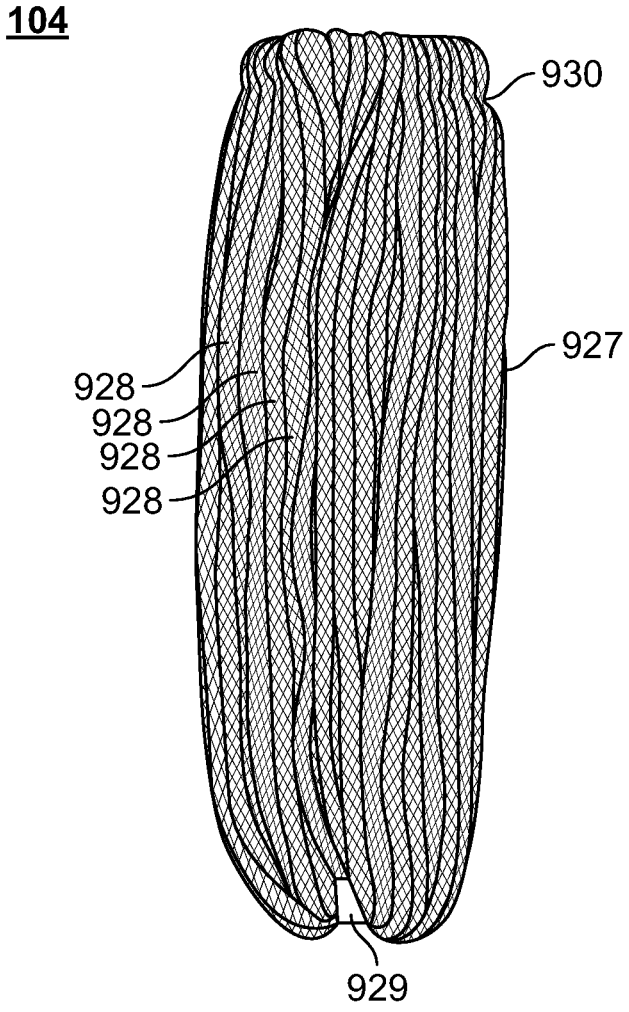
FIG. 9 illustrates a mop head in accordance with certain embodiments of the present disclosure.

FIG. 9 illustrates the mop head 104 in accordance with certain embodiments of the present disclosure. In this example the mop head 104 is a looped mop head utilizing a continuous cord 927. The cord 927 is arranged in a plurality of loops 928, where each loop is sewn together with string 930 and the midsection of the plurality of loops may be bound by a loop strap 929. In other examples, the mop head may be open ended and therefore a plurality of cords are bundled and attached together.

The number of loops 928 within the mop head 104 may vary between examples. For instance, the mop head 104 can include less than thirty loops 928 or over seventy loops 928. However, generally a mop head 104 includes between thirty and seventy loops 24. For example, the mop head 104 can include about fifty loops 928.

Likewise, the length of the mop head 104 can vary between examples. In some examples, the length of the mop head is about thirty-five centimeters.

Figure 10:
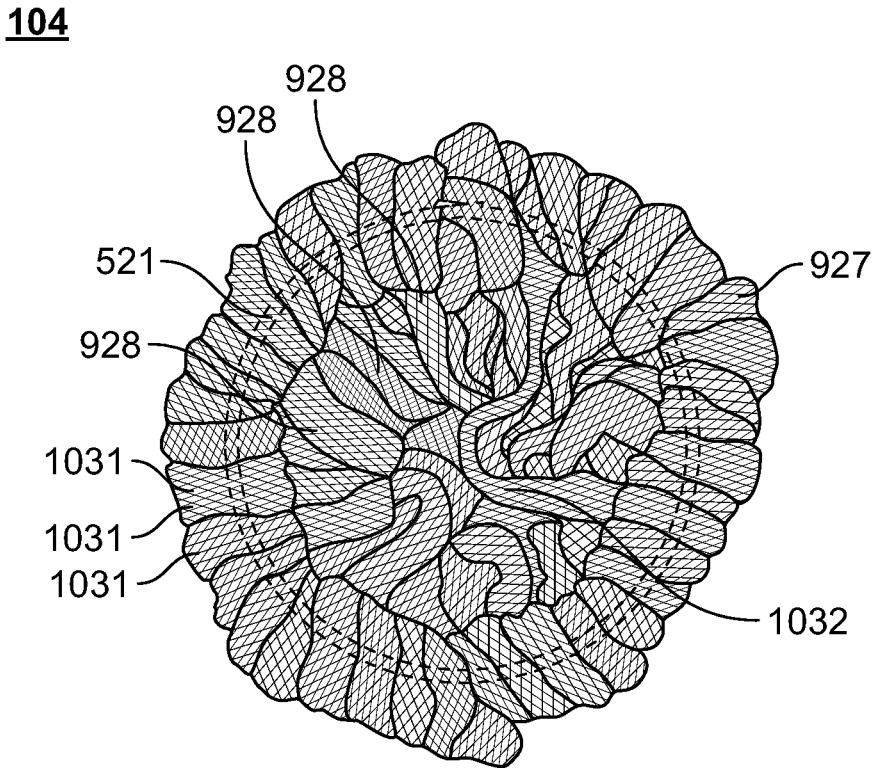
FIG. 10 is a top view of the mop head of FIG. 9 in accordance with certain embodiments of the present disclosure.

FIG. 10 is a top view of the mop head 104 in accordance with certain embodiments of the present disclosure. In this example, a top end of the mop head 104 is wrapped around the collar 521, and the continuous cord 927 is arranged around the collar 521 such that the continuous cord 927 forms the plurality loops 928. Each of the plurality of loops 928 are attached together such that a plurality of apertures 1031 is formed at the top of the plurality of loops 928. The collar 521 rests within the plurality of apertures 1031.

In some examples, as shown in FIG. 10, when the two ends of the collar 521 are connected, the collar 521 has a closed circular shape. As a result, the collar 521 and the continuous cord 927 arranged around the collar 521 define an interior space 1032. In some examples, a diameter of the collar 521 is about 7.8 centimeters.

Figure 11:
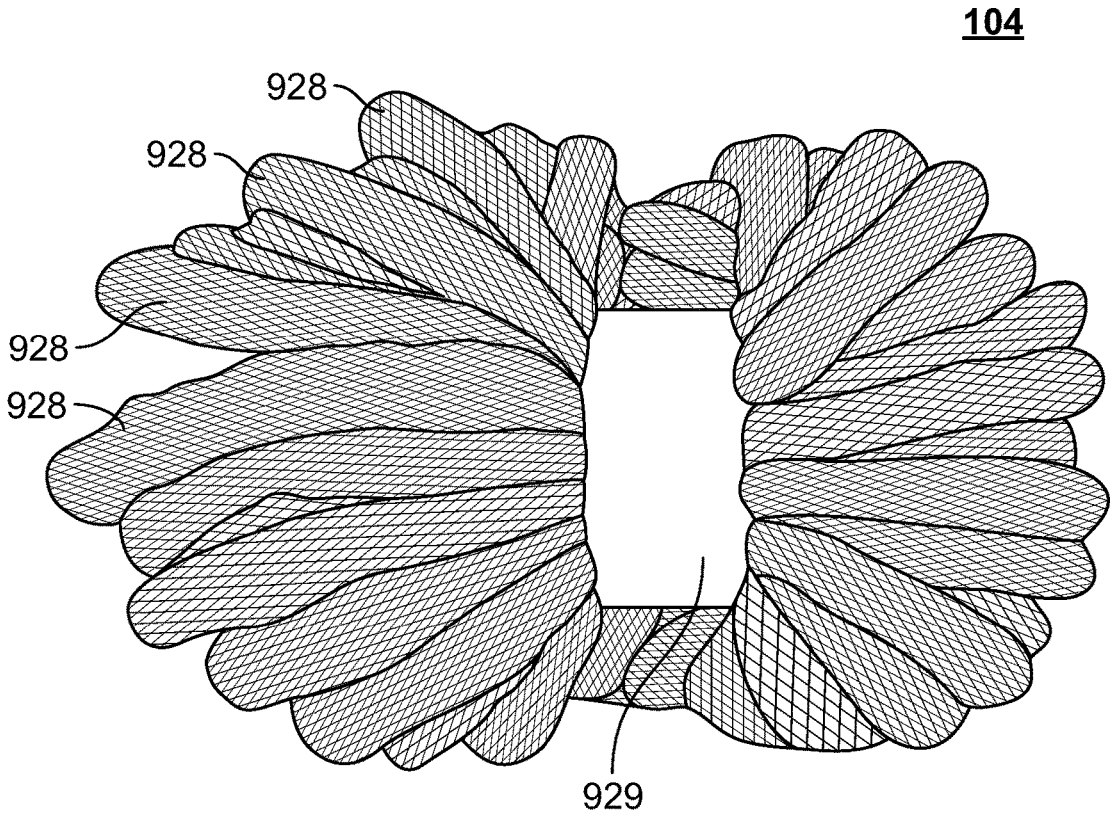
FIG. 11 is a bottom view of the mop head of FIG. 9 in accordance with certain embodiments of the present disclosure.

FIG. 11 is a bottom view of the mop head 104 in accordance with certain embodiments of the present disclosure. In this example, a loop strap 929 is configured to wrap around a mid-section of the plurality of loops 928.

The loop strap 929 can include a number of materials including, but not limited to, tape, fabric, hook and loop fasteners, cable ties, zip ties, rubber bands, plastic and other similar materials capable of binding the plurality of loops 928. Generally, a lock ring, such as lock rings 318 and 421, can be placed on top of the loop strap 929. However, in some examples, a lock ring may be used directly in place of a loop strap 929.

Figure 12:
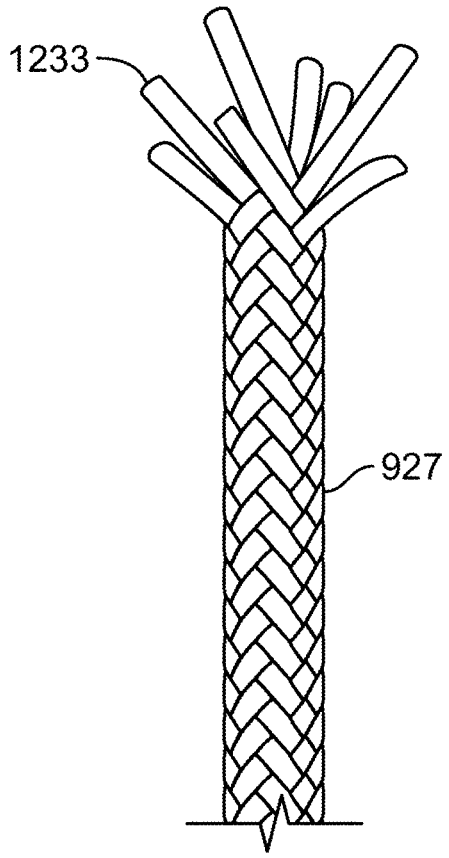
FIG. 12 illustrates a section of a continuous cord for the mop head of FIG. 9 in accordance with certain embodiments of the present disclosure.

FIG. 12 illustrates a section of the continuous cord 927 in accordance with certain embodiments of the present disclosure. In this example, the continuous cord 927 includes a plurality of strands 1233 braided together. While this figure illustrates a continuous braided cord of looped mop design, a braided cord may also be utilized within an open ended mop design, wherein a plurality of braided cords may be bundled or attached together.

The braided cord 927 includes a body which is substantially similar to a "Chinese finger trap"—the diameter of the braided cord 927 narrows as its two ends are pulled away from each other. Pulling the entire braid lengthens and narrows it. The length is gained by reducing the angle between the warp and weft threads at their crossing points, but this reduces the radial distance between opposing sides and hence the overall circumference. The more one pulls, the more the circumference shrinks and the braid tightens. Hence, the braided cord 927 can absorb liquid in a low-tension state where the circumference is exploited and can expel an absorbed liquid when the braided cord 927 is stretched. Similarly, the braided cord 927 can also be wrung out if twisted, compressed, or squeezed.

As noted above, at least one disadvantage of a twisted string is its propensity to unravel. In contrast, a braided cord 927 can withstand much more abuse than a twisted string and its braided body continues to provide support even with a spliced strand or end. For example, if a single strand of a twisted string were to break, none of remaining intact strands would provide support to that broken strand. Thus, the broken strand in a twisted string could potentially unravel throughout the entire length of the string. In contrast, if a single strand of the braided cord were to tear, the intertwining structure of the braid can resist the unraveling force of the single broken strand. Likewise, if the entire cord is spliced, a twisted string would unravel completely, whereas a braided cord might unravel near the end but would retain its braided structure long enough for a quick repair.

Moreover, the structural integrity of a braided cord is integral to its braided design, unlike a twisted string, whose structural integrity relies on a stitch thread that runs vertically along the mop head. A broken stitch thread results in an untwisted string. Also, certain mop heads with twisted strings include a horizontal band stitched around the twisted strings to reinforce the twists and prevent tangling. The braided cord, on the other hand, is less likely to become tangled.

The number of strands 1233 within the braided cord 927 can affect at least the durability and flexibility of cord 927. Therefore, the number of strands 1233 within the braided cord 927 can vary in alternate examples, depending on desired characteristics. For instance, a braided cord 927 with fewer strands 1233 will generally be more flexible (and perhaps easier to maneuver around the hard-to-reach areas on the floor), while a braided cord 927 with more strands 1233 will generally provide for a more durable braid.

Referring to FIG. 12, it may be preferable for the braided cord 927 to include eight strands 1233. For instance, an eight stranded braided cord 927 has comparable flexibility to braids with fewer strands 1233, and likewise, has comparable durability to mop heads with greater than eight strands 1233. However, as noted above, the number of strands 1233 can vary in alternate examples. Thus, a braided cord 927 may have three or more strands 1233.

The mop head material may vary in alternate examples, but generally the mop head includes material that will not scratch any surface and is highly absorbent. Additionally, the material itself is generally quite durable. For instance, in some examples, the mop head material may endure the toughest washing machine cycles. The material can include but is not limited to polyester, polyamide, cotton, microfiber, viscose, nylon, or synthetic fibers. For example, the mop material may include a unique absorbent "chenille" synthetic fiber. This fiber absorbs a large volume of liquid, but also readily releases the liquid when compressed. These properties typically exist exclusively. In some examples, one of the plurality of strands 1233 forming the braided cord 927 may include a different material than other strands within the plurality of strands 1233.

Figure 13:
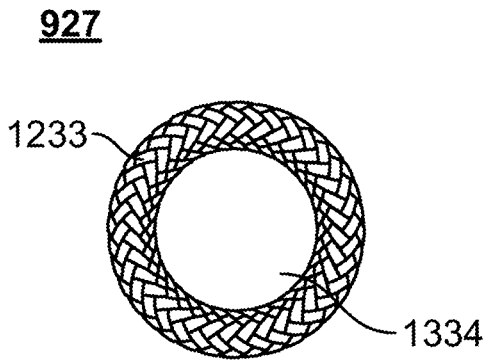
FIG. 13 is a cross section view of the continuous cord of FIG. 12 in accordance with certain embodiments of the present disclosure.

FIG. 13 is a cross section view of the continuous cord 927 in accordance with certain embodiments of the present disclosure. As shown in this example, the strands 1233 of the braided cord 927 define a core 1334. In certain embodiments, the core 1334 within the braided cord 927 is hollow and can provide increased absorbent qualities as compared to other cords. For instance, when liquid is absorbed by the braided cord 927, the strands 1233 of the cord 927 can expand into the core 1334 without substantially increasing the circumference of the braided cord 927. In other embodiments, the core 1334 may be filled with a material, which may or may not be of the same material as the braided cord 927, to further increase the absorbent qualities of the braided cord 927. Thus, the core 1334 generally increases the ability of the braided cord 927 to absorb liquid.

The size of the core 1334 may vary between examples for many reasons including, but not limited to, the number of strands 1233 in the braided cord 927, the size of the strands 1233, the braid tightness, and the amount of liquid absorbed by the strands 1233. For instance, if the braided cord 927 is pulled, the core 1334 may be extremely small or substantially non-existent. Likewise, if the braided cord 927 has absorbed liquid, the strands 1233 may expand such that the core 1334 may be extremely small or substantially non-existent.

Figure 14:
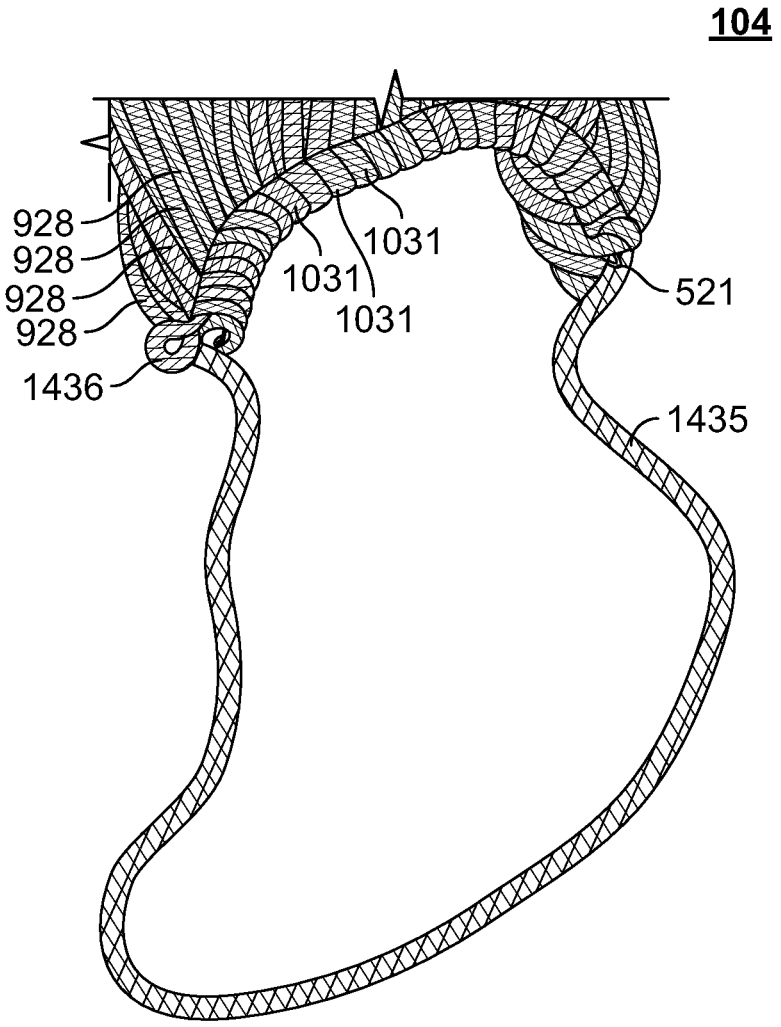
FIG. 14 illustrates the mop head of FIG. 9 in accordance with certain embodiments of the present disclosure.

FIG. 14 illustrates another view of the mop head 104 in accordance with certain embodiments of the present disclosure. In this example, for illustrative purposes, the ends of the collar 521 are disconnected, and a single loop 1435 has been separated from the plurality of loops 928, and a single aperture 1436 of the plurality of apertures 1031 has been pulled off the collar 521. Typically, the number of apertures 1031 within a mop head 104 depends on the number of loops 928, where the number of apertures 1031 is generally about two times the number of loops 928.

In some examples, the mop head 104 is machine washable. As partly illustrated in FIG. 14, each of the plurality of apertures 1031 may be removed from the collar 521. Therefore, the entire mop head 104 including the collar 521 may be washed together or the collar 521 may be removed and the mop head 104 may be washed separately from the collar 521.

On the other hand, the mop head 104 may be completely replaced with a new mop head or portions of the mop head may be replaced. For instance, the collar 521 may be replaced with a new collar 521, the continuous braided cord 927 may be replaced, or the entire mop head 104 may be replaced.

Figure 15:
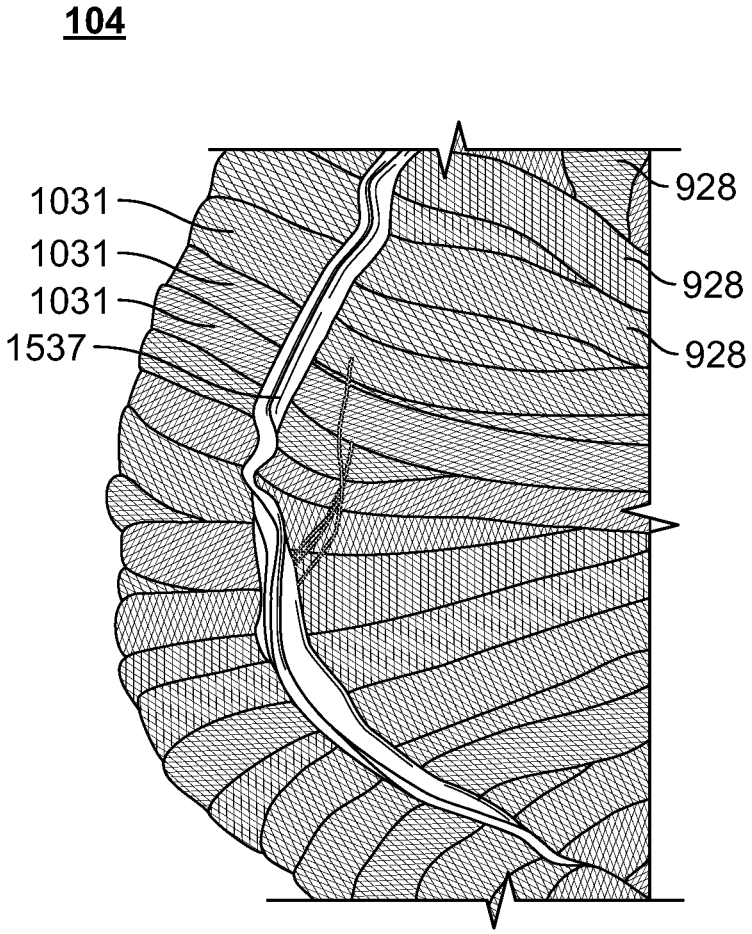
FIG. 15 is a close-up view of the interior of the mop head of FIG. 9 in accordance with certain embodiments of the present disclosure.

FIG. 15 is a close-up view of the interior of the mop head 104 in accordance with certain embodiments of the present disclosure. In this example, the pluralities of loops 928 are attached together by a sewn piece 1537. This sewn piece 1537 not only attaches an individual loop to itself such that an aperture is formed, but also attaches each of the plurality of loops together, such that the apertures are substantially aligned.

While FIG. 15 illustrates the plurality of loops 928 sewn together, the loops 928 may be attached in a variety of ways. For example, the plurality of loops 928 may be secured together with adhesive, pinned together, tied together, and the like.

It is appreciated that the disclosure is not limited to the described embodiments, and that any number of scenarios and embodiments may exist. Although the disclosure has been described with reference to several exemplary embodiments, it is understood that the words that have been used are words of description and illustration, rather than words of limitation. Changes may be made within the purview of the appended claims, as presently stated and as amended, without departing from the scope and spirit of the disclosure in its aspects. Although the disclosure has been described with reference to particular means, materials and embodiments, the disclosure is not intended to be limited to the particulars disclosed; rather the disclosure extends to all functionally equivalent structures, methods, and uses such as are within the scope of the appended claims.

We claim:

1. A mop comprising:

a mop pole;

a lower handle grip mounted around a lower portion of the mop pole and configured to move axially along the mop pole;

an upper handle grip at least partially mounted around an upper portion of the mop pole and configured to move axially along the mop pole; and a rotational mechanism capable of imparting rotation into the mop pole in response to the axial movement of the upper handle grip, wherein the rotational mechanism comprises:

two or more inserts attached to internal walls of the upper handle grip, the two or more inserts including prongs;

a rotatable portion attached to a top end of the mop pole, the rotatable portion including a set of teeth; and a rotating element having grooves and another set of teeth, wherein as the upper handle grip is moved axially along the mop pole, the prongs of the inserts catch the grooves of the rotating element and cause the rotating element to rotate, and during rotation of the rotating element, the teeth of the rotating element catch the teeth of the rotatable portion thereby imparting a rotation into the mop pole.

2. The mop of claim 1, wherein the rotational mechanism further comprises a plug attached to an end of the rotating element, wherein the plug serves as a damper.

3. The mop of claim 1, wherein the rotational mechanism is entirely internal to the upper handle grip.

4. The mop of claim 1, wherein the rotational mechanism is at least partially external to the upper handle grip.

5. The mop of claim 1, further comprising a quick connect mechanism mounted to a bottom end of the mop pole.

6. The mop of claim 5, wherein the quick connect mechanism is capable of attaching to a bottom portion of a mop head.

7. The mop of claim 6, wherein the quick connect mechanism comprises:

a cup attached to the bottom end of the mop pole; and a hinged member configured to secure a lock ring mounted on the mop head within the cup.

8. The mop of claim 6, wherein the quick connect mechanism comprises a receiver clip capable of receiving a lock ring mounted on the mop head.

9. The mop of claim 1, wherein the lower handle grip is capable of attaching to a top portion of a mop head.

10. The mop of claim 9, wherein the lower handle grip is configured to accept a mop head collar, wherein the mop head collar secures around a bottom portion of the lower handle grip.

11. The mop of claim 1, further comprising a hook secured to the top of the mop pole.

12. The mop of claim 1, wherein downward axial movement on the upper grip handle imparts a rotation into the mop pole, wherein upward axial movement of the upper grip handle does not impart a rotation into the mop pole.

13. The mop of claim 1, wherein upward axial movement on the upper grip handle imparts a rotation into the mop pole, wherein downward axial movement of the upper grip handle does not impart a rotation into the mop pole.

14. A method of wringing out a mop having a rotational mechanism capable of imparting rotation into the mop pole in response to the axial movement of the upper handle grip, the method comprising:

sliding a lower handle grip along an axis of a mop pole to its top-most position on the mop pole; and repeatedly sliding an upper handle grip upward and downward along an axis of a mop pole, wherein a downward movement of the upper handle grip causes the rotational mechanism to impart a rotation into the mop pole, the rotation into the mop pole rotates a bottom of a mop head relative to a top of the mop head, and successive downward movements of the upper handle grip each cause further rotation of the bottom of the mop head relative to the top of the mop head.

15. The method of claim 14, wherein the downward movement of the upper handle grip does not include a rotational movement of the upper grip handle.

16. The method of claim 14, further comprising:

following the downward movement of the upper handle grip, sliding the upper handle grip upward, and repeating the downward movement and the upward sliding of the upper grip handle to further rotate the mop pole.

17. The method of claim 14, wherein the upward movement of the upper handle grip does not cause the rotation mechanism to impart a rotation into the mop pole.

18. The method of claim 14, wherein the upward movement of the upper handle grip causes the rotation mechanism to impart a further rotation into the mop pole.

19. A method of wringing out a mop having a rotational mechanism capable of imparting rotation into the mop pole in response to the axial movement of the upper handle grip, the method comprising:

sliding a lower handle grip along an axis of a mop pole to its bottom-most position on the mop pole; and repeatedly sliding an upper handle grip upward and downward along an axis of a mop pole, wherein an upward movement of the upper handle grip causes the rotational mechanism to impart a rotation into the mop pole, the rotation into the mop pole rotates a bottom of a mop head relative to a top of the mop head, and successive upward movements of the upper handle grip each cause further rotation of the bottom of the mop head relative to the top of the mop head.

* * * * *